US007066833B2

(12) United States Patent
Yamamoto

(10) Patent No.: US 7,066,833 B2
(45) Date of Patent: Jun. 27, 2006

(54) GOLF CLUB HEAD

(75) Inventor: Akio Yamamoto, Kobe (JP)

(73) Assignee: Sumitomo Rubber Industries, Ltd., Kobe (JP)

( * ) Notice: Subject to any disclaimer, the term of this patent is extended or adjusted under 35 U.S.C. 154(b) by 250 days.

(21) Appl. No.: 10/372,786

(22) Filed: Feb. 26, 2003

(65) Prior Publication Data

US 2003/0181257 A1 Sep. 25, 2003

(30) Foreign Application Priority Data

Mar. 20, 2002 (JP) ..... 2002-079191

(51) Int. Cl.
*A63B 53/04* (2006.01)

(52) U.S. Cl. ..... 473/330; 473/331

(58) Field of Classification Search ..... 473/330, 473/331, 342

See application file for complete search history.

(56) References Cited

U.S. PATENT DOCUMENTS

| | | | | | |
|---|---|---|---|---|---|
| 4,508,349 | A | * | 4/1985 | Gebauer et al. | 473/330 |
| 5,282,624 | A | * | 2/1994 | Viste | 473/342 |
| 5,735,755 | A | * | 4/1998 | Kobayashi | 473/342 |
| 6,299,548 | B1 | * | 10/2001 | Lin | 473/331 |
| 6,322,459 | B1 | * | 11/2001 | Nishimura et al. | 473/330 |
| D481,432 | S | * | 10/2003 | Greene | D21/748 |

* cited by examiner

*Primary Examiner*—Gregory Vidovich
*Assistant Examiner*—Nini F. Legesse
(74) *Attorney, Agent, or Firm*—Birch, Stewart, Kolasch & Birch, LLP

(57) ABSTRACT

A golf club head comprises a face portion having a front face defining a clubface for hitting a ball and a back face facing a hollow, wherein the clubface is provided along the edge thereof with a frontal groove having a groove width of not less than 0.5 mm, and the back face is provided with a backside groove extending along the frontal groove.

14 Claims, 8 Drawing Sheets

Ex.2

Ref.1

GOLF CLUB HEAD

BACKGROUND OF THE INVENTION

The present invention relates to a golf club head, more particularly to an improved structure of the face portion being capable of improving the coefficient of restitution.

In order to increase the carry of the struck ball, various improvements have been made on the face portion of a golf club head for the purpose of increasing the coefficient of restitution of the face portion.

In case of a golf club head having a hollow behind the face portion, for example, the face portion is made using a thin metal material to improve the flexure when hitting a ball. In this case, even if a material having flexure strength is used, it is difficult to provide sufficient durability for the impact area or the central portion of the clubface. In another design, therefore, to achieve a high restitution coefficient and durability at the same time, a groove is formed on the periphery of the back face of the face portion to leave the impact area thicker. In this case too, the improvement has its limit as is usual, and even if the width and depth of the groove are well controlled, it is difficult to further the improvement in the coefficient of restitution.

SUMMARY OF THE INVENTION

It is therefore, an object of the present invention to provide a golf club head, in which the face portion is further improved in the coefficient of restitution without deteriorating the durability.

According to the present invention, a golf club head comprises a face portion having a front face defining a clubface for hitting a ball and a back face facing a hollow, wherein the clubface is provided with a frontal groove having a groove width of not less than 0.5 mm and extending along the edge of the clubface, and the back face is provided with a backside groove extending along the frontal groove.

BRIEF DESCRIPTION OF THE DRAWING(S)

Figure 7A:
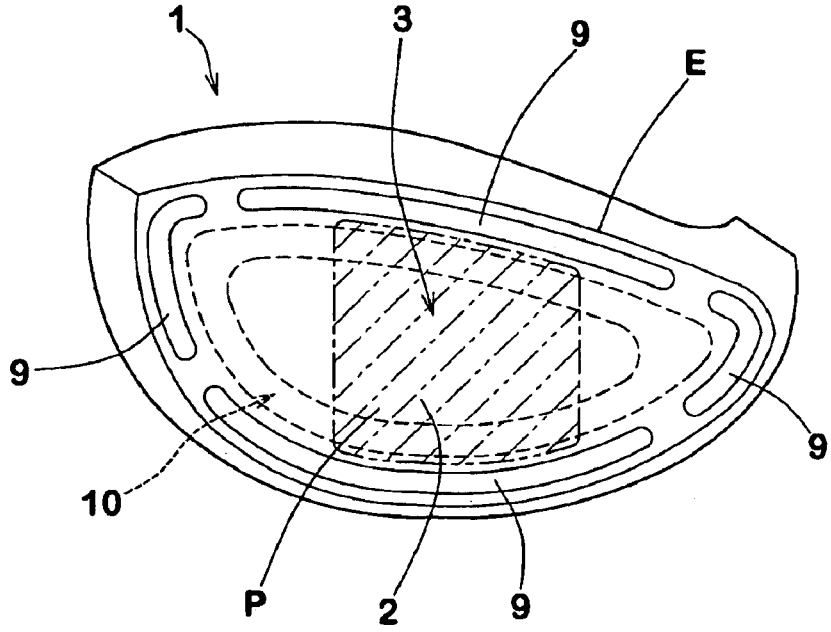
Figure 7B:
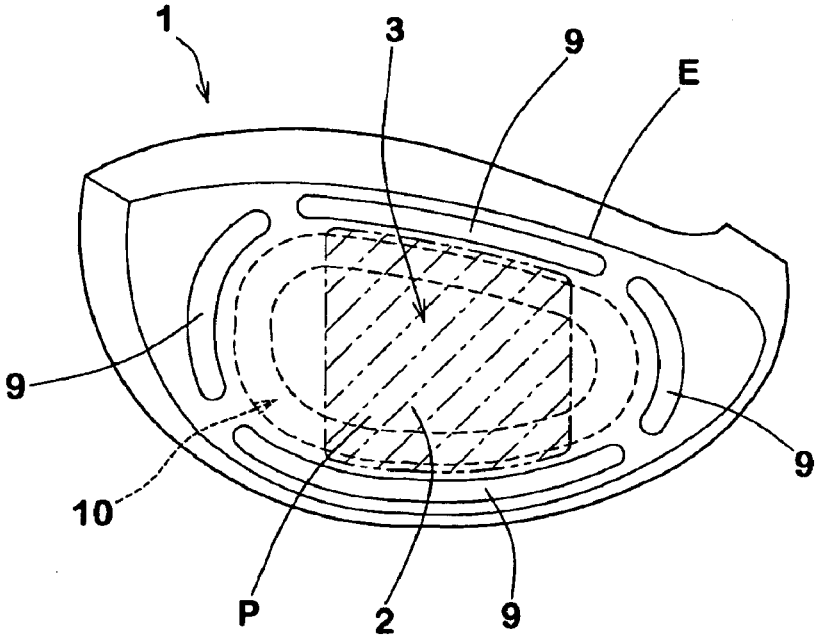

FIGS. 7(*a*) and 7(*b*) are front views of other embodiments of the present invention.

Figure 8A:
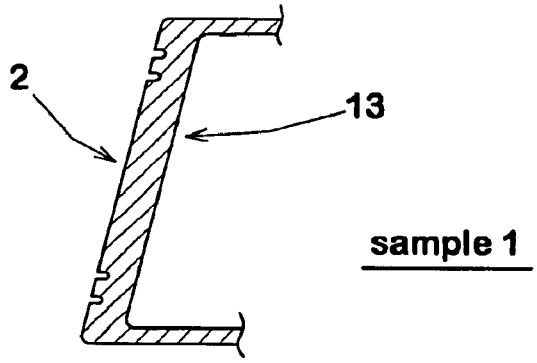
Figure 8B:
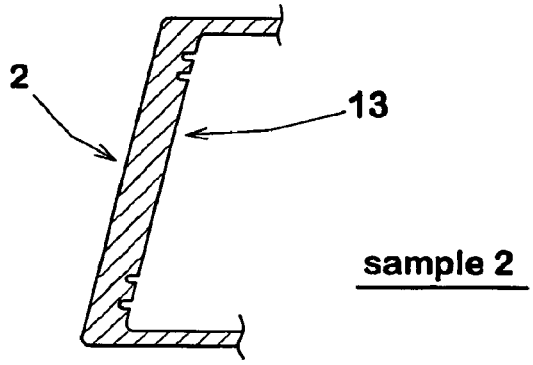
Figure 8C:
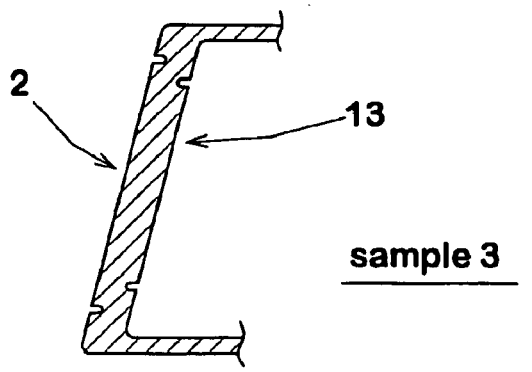

FIGS. 8(*a*), 8(*b*) and 8(*c*) are schematic cross sectional views showing the face portions of club heads which were used in preliminary tests.

Figure 9A:
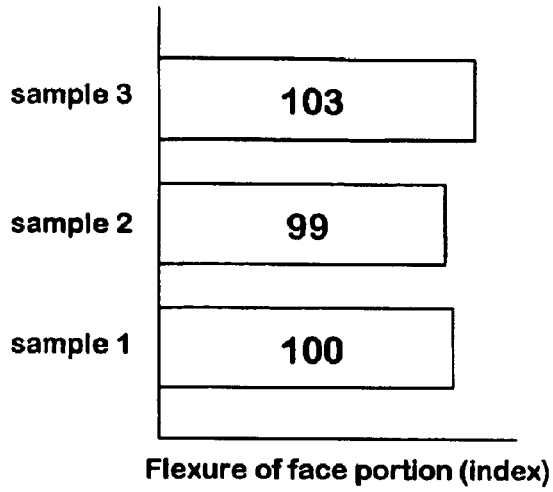
Figure 9B:
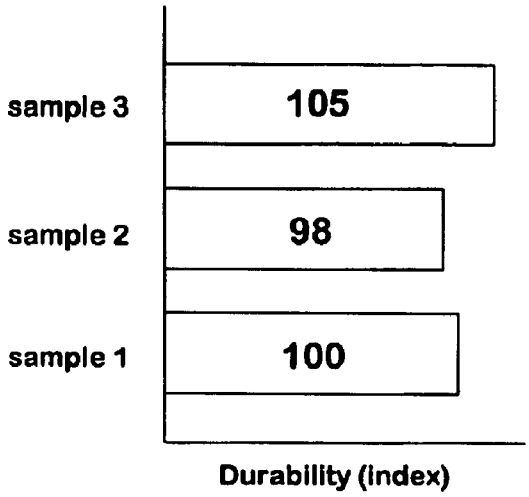
Figure 9C:
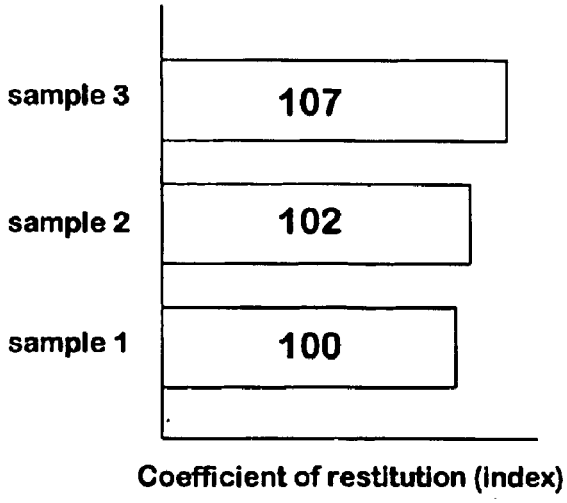

FIGS. 9(*a*), 9(*b*) and 9(*c*) are histograms showing the results of the preliminary tests.

FIGS. 10, 11, 12 and 13 show club heads used in the undermentioned comparison tests as Ex.2, Ref.1, Ref.2 and Ref.3, respectively.

DESCRIPTION OF THE PREFERRED EMBODIMENT(S)

Embodiments of the present invention will now be described in detail in conjunction with the accompanying drawings.

In the drawings, golf club head 1 according to the present invention comprises a face portion 3 of which front face defines a clubface 2, a crown portion 4 intersecting the clubface 2 at the upper edge 2*a* thereof, a sole portion 5 intersecting the clubface 2 at the lower edge 2*b* thereof, a sidewall portion 6 between the crown portion 4 and sole portion 5 which extends from a toe-side edge 2*t* to a heel-side edge 2*e* of the clubface 2 through the back side of the club head, and a neck portion 7 to be attached to an end of a club shaft (not shown).

The neck portion 7 is provided with a shaft inserting hole 7*a* having an opening for the club shaft at the upper end thereof. The axis CL of the shaft inserting hole 7*a* is used instead of the axis of the inserted club shaft when setting up the clubhead alone in the undermentioned measuring state.

In FIGS. 1–5 showing an embodiment of the present invention, the club head 1 is a hollow wood-type golf club head for number one (#1) driver. The club head 1 has a shell body which is formed by the face portion 3, crown portion 4, sole portion 5 and sidewall portion 6, defining a closed cavity (i) therein. It is possible to leave the cavity (i) void, but it is also possible to provide a filler made of a material such as foamed plastic, foamed rubber and elastomers which does not alter the rigidity of the club head.

In this embodiment, an alpha-beta-type titanium alloy (Ti—6Al—4V) is used as the material of the club head, and lost-wax precision casting is employed as the making method. However, various metal materials such as aluminum alloys, pure titanium, titanium alloys and stainless steel may be used. In order to make parts of the club head 1, aside from casting, forging, press working and the like may be employed depending on the material used.

According to the present invention, the clubface 2 is provided outside the impact area P with a frontal groove 9 extending along the edge E (2*a*, 2*b*, 2*t* and 2*e*) of the clubface 2, and the back face 13 of the face portion 3 is provided with a backside groove 10 extending along the frontal groove 9. Therefore, the flexibility of the face portion 3 is improved and the coefficient of restitution can be improved to increase the carry of the struck ball. This is based on test results conducted by the inventor, using a club head (Sample 1) provided in the clubface 2 with two annular grooves as shown in FIG. 8(*a*), a club head (Sample 2) provided in the back face 13 with two annular grooves as shown in FIG. 8(*b*) and a club head (Sample 3) provided in each of the clubface 2 and back face 13 with an annular groove as shown in FIG. 8(*c*). As shown in FIGS. 9(*a*), 9(*b*) and 9(*c*), the test results unexpectedly show that, in Sample 3, the face portion displayed the most flexibility, the largest coefficient of restitution, and the best durability although the annular grooves of all the heads were identical with respect to the cross sectional shape.

Figure 1:
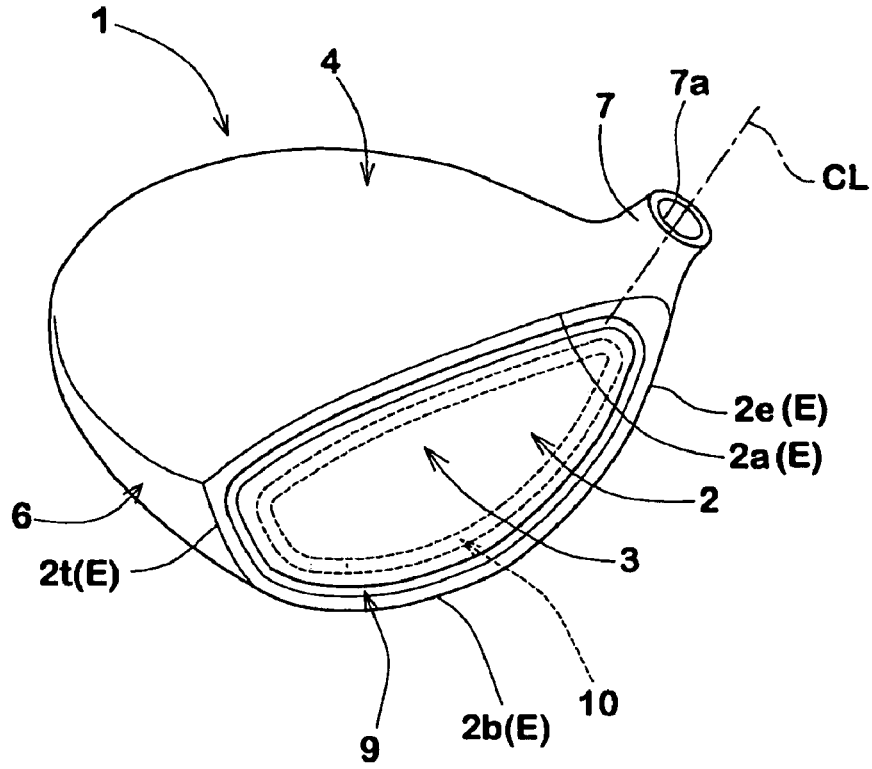
FIG. 1 is a perspective view of a wood-type golf club head according to the present invention.
Figure 2:
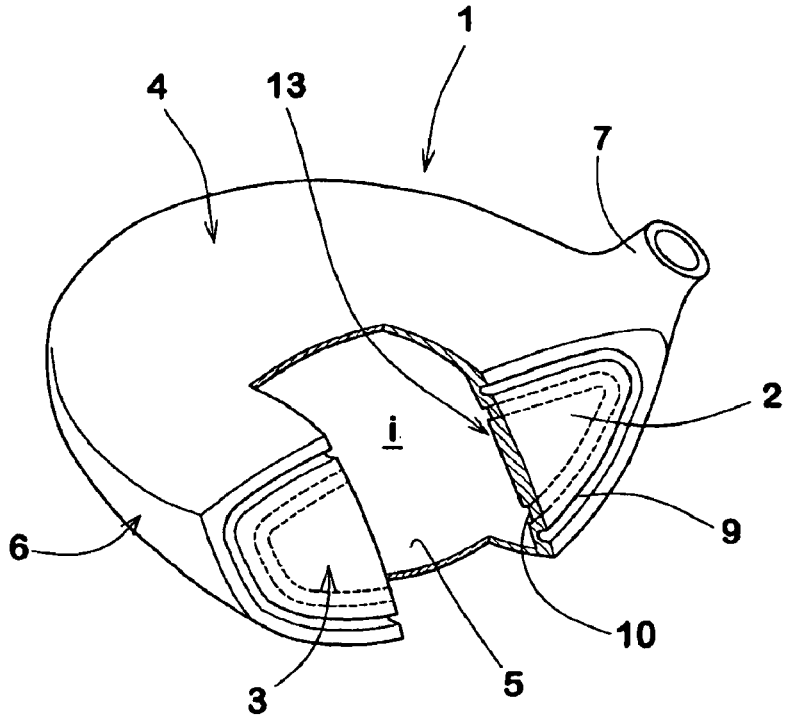
FIG. 2 is the same perspective view as FIG. 2, but the club head is partially cut off.
Figure 3:
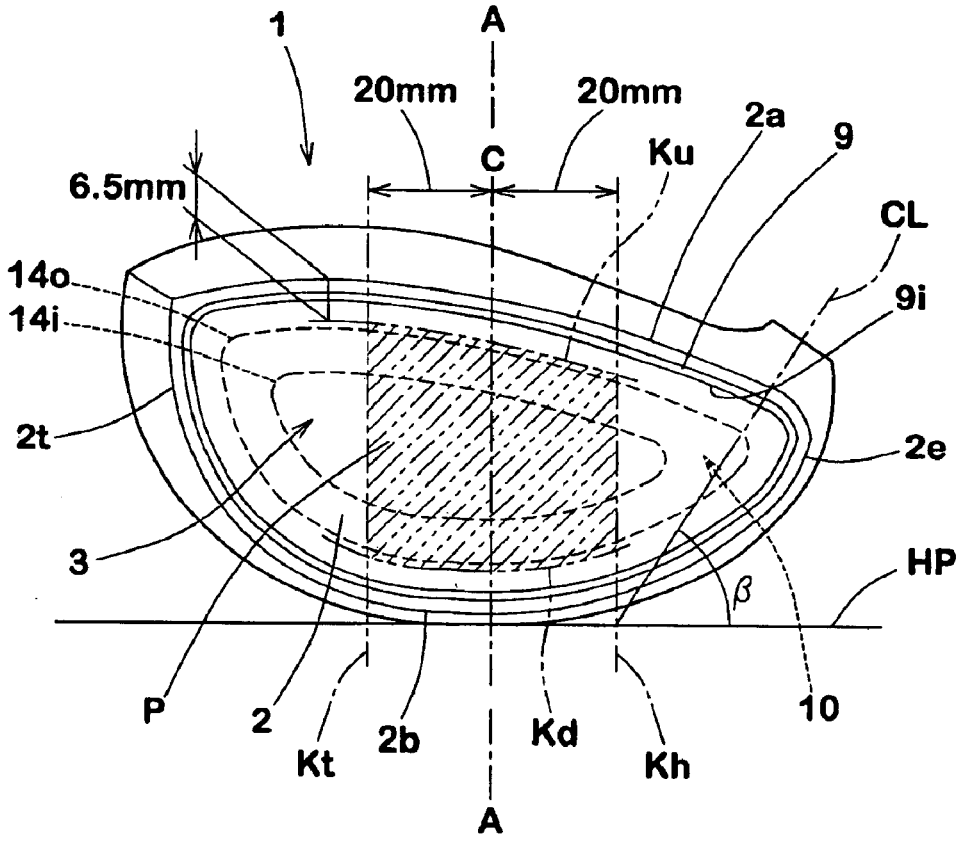
FIG. 3 is a front view thereof.

The above-mentioned impact area P is, as shown in FIG. 3, defined as being surround with four lines (Kt, Kh, Ku and Kd) on the clubface 2. Two lines Kt and Kh are parallel with a clubface center line C, wherein one line Kt is drawn at a distance of 20 mm towards the toe-side from the clubface center line C, and the other line Kh is drawn at a distance of 20 mm towards the heel-side from the clubface center line C.

The remaining two lines Ku and Kd are parallel with the edge (2*a*, 2*b*) of the clubface 2, wherein one line Ku is drawn at a distance of 6.5 mm from the upper edge 2*a*, and the other line Kd is drawn at a distance of 6.5 mm from the lower edge 2*b*. Here, the clubface center line c is a vertical line drawn on the clubface passing the midpoint between the toe-side end and heel-side end of the clubface 2 with respect to the horizontal direction under a measuring state of the club head 1. The measuring state is such that the club head 1 is put on a horizontal plane HP such that the shaft axis CL of the shaft inserting hole 7*a* inclines at the predetermined lie angle β within a vertical plane, and an angle between the above-mentioned vertical plane and a horizontal tangential line to the centroid of the clubface 2 becomes the predetermined face angle.

It is essential that the frontal groove 9 is formed outside the impact area P. But, it is not always necessary that the frontal groove 9 is exactly parallel with the clubface edge E through the entire length. If the impact area P includes the frontal groove 9, the bounce direction of the ball is liable to be disturbed because the frequency of hitting balls by the grooved part increases.

Figure 4:
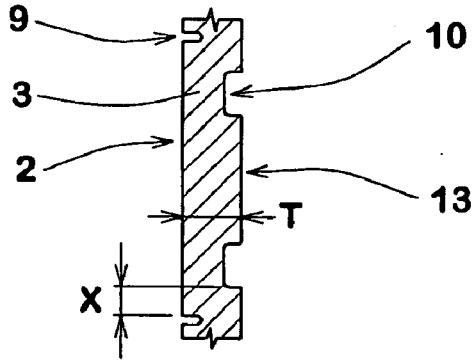
FIG. 4 is a cross sectional view of the face portion taken along a line A-A of FIG. 3.
Figure 5:
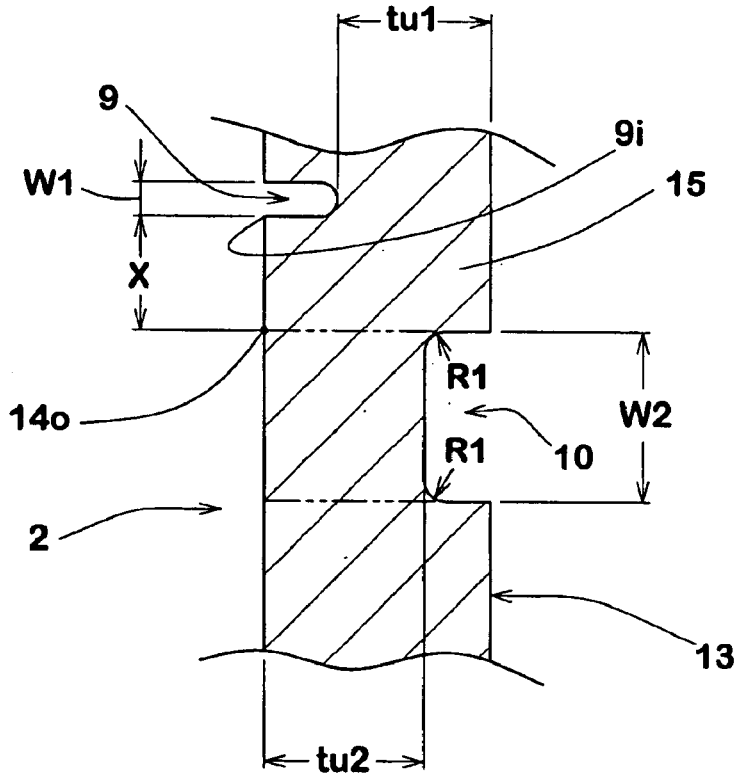
FIG. 5 is an enlarged cross sectional view of the face portion showing an exemplary arrangement of the frontal groove and backside groove.

As to the position of the backside groove 10, it is preferable that, when viewed from the front as shown in FIG. 3, the backside groove 10 is completely encompassed by the frontal groove 9 without being overlapped in order to prevent the durability from decreasing. Strictly speaking, as shown in FIGS. 3, 4 and 5, a positive distance x is formed between the inner groove edge 9*i* of the frontal groove 9 and a line 14*o* which is defined by the outer groove edge of the backside groove 10 projected on the clubface 2. (incidentally, "14*i*" is a projected line of the inner groove edge) Preferably, the distance x is set in a range of from 2.5 to 10 mm, more preferably 2.5 to 5.0 mm.

In order to provide a certain distance between the frontal groove 9 and the impact area P, the groove width w1 is preferably limited to at most 4.0 mm, more preferably at most 3.0 mm. if the groove width w1 is less than 0.5 mm, it becomes difficult to effectively improve the coefficient of restitution. Therefore, the groove width w1 of the frontal groove 9 is at least 0.5 mm.

The groove width w2 of the backside groove 10 is set in a range of from 1.0 to 15.0 mm, preferably 3.0 to 15.0 mm, more preferably 4.0 to 10.0 mm. If the groove width w2 is less than 1 mm, it is difficult to decrease the rigidity of the face portion 3. If the groove width w2 is more than 15.0 mm, the durability of the face portion 3 is liable to decrease.

In this embodiment, as shown in FIG. 5, the backside groove 10 is wider than the frontal groove 9. Preferably, the ratio (w2/w1) of the groove width w2 of the backside groove 10 to the groove width w1 of the frontal groove 9 is set in a range of from 6 to 30, more preferably 10 to 20, whereby the flexure of the central part of the face portion 3 at the time of impact is promoted.

If the frontal groove 9 is too shallow, it is difficult to decrease the rigidity of the face portion 3. If the frontal groove 9 is too deep, the durability of the face portion 3 decreases. Therefore, the depth is determined such that, as shown in FIG. 5, the thickness tu1 of the face portion 3 at the deepest point of the bottom of the frontal groove 9 becomes in a range of from 1.5 to 2.5 mm, preferably 1.8 to 2.3 mm, whereby the durability and coefficient of restitution become compossible.

For the same reason as the frontal groove 9, the depth of the backside groove 10 is determined such that the thickness tu2 of the face portion 3 at the deepest point of the bottom of the backside groove 10 is in a range of from 1.5 to 2.5 mm, preferably 1.8 to 2.3 mm.

In the above-mentioned impact area P, the thickness T of the face portion is substantially constant and set in a range of from 2.4 to 3.3 mm in order to provide sufficient strength against impact.

In order to avoid stress concentration and thereby to improve the durability, the corners of the bottom of the frontal groove 9 and/or backside groove 10 are preferably rounded as shown in FIG. 5 by a circular arc whose radius R1 is in a range of from 2.0 to 4.0 mm. If the groove width (w1, w2) is less than 2.0 mm as in the frontal groove 9 shown in FIG. 5, the groove bottom as a whole is formed by a circular arc (substantially half circle in FIG. 5).

Figure 6:
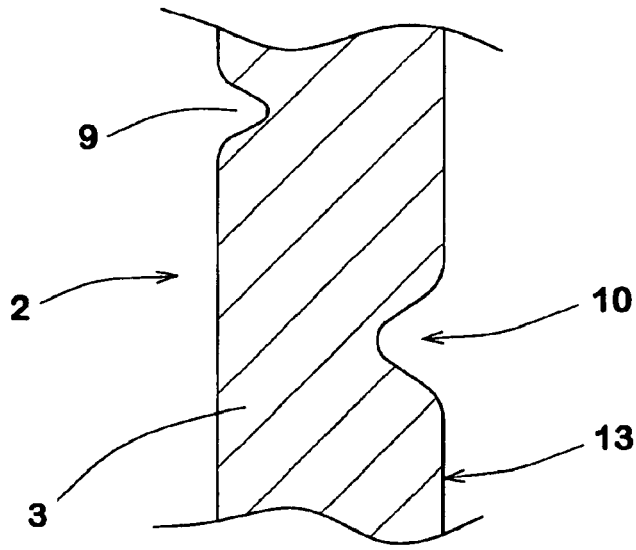
FIG. 6 is an enlarged cross sectional view showing another example of the cross sectional shape of the grooves.

On the other hand, the groove edges in this embodiment are angled as shown in FIG. 5. But, it is also possible to round the groove edges as shown in FIG. 6.

As to the cross sectional shapes of the frontal groove 9 and backside groove 10, it is possible to use various shapes, for example, U-shapes (FIG. 5) wherein two or three straight lines are connected through one or two circular arcs, V-shapes (FIG. 6) wherein two straight lines are connected through a circular arc, a shape defined by a smoothly curved line made up of circular arcs, a shape defined by a multi-radius curve and the like.

As the frontal groove 9 extends along the edge E of the clubface 2, and

In this embodiment, as the frontal groove 9 and backside groove 10 are each continuous or annular, the rigidity of the face portion 3 can be effectively reduced in the periphery part. Thus, the coefficient of restitution can be effectively improved. It is however also possible that the frontal groove 9 is interrupted as shown in FIGS. 7(*a*) and 7(*b*) as far as the total length of the frontal groove 9 is at least 40%, preferably more than 50% of the overall circumferential length of the edge E of the clubface.

Comparison Tests

Wood-type golf club heads (head volume=305 cc, weight=190 g) for #1 driver having the same structure except for the face portion were made using titanium alloy Ti—6Al—4V and tested for the coefficient of restitution and durability.

The specifications and test results are shown in Table 1.

Restitution Coefficient Test

According to the "Procedure for Measuring the velocity Ratio of a club Head for conformance to Rule 4-1e, Appendix II, Revision 2 (Feb. 8, 1999), United states Golf Association.", the restitution coefficient "e" was obtained using the following equation:

$$Vo/Vi=(eM-m)/(M+m)$$

wherein

Vo: ball rebound velocity

Vi: ball incoming velocity

M: the mass of the club head m: the mass of the ball.

As specified therein, the golf balls used were "Titleist, PINNACLE GOLD" and the radius of the target circle centered on the sweet spot was 5 mm. The distance between the clubface and the launching device was 55 inches, and the incoming ball velocity was 160±0.5 feet/sec.

Durability Test

The golf club head was attached to an FRP shaft to make a 46-inch driver. The club was attached to a swing robot and hit two-piece balls 3000 times at a head speed of 51 M/s. Then, the clubface was checked and if a dent was found the depth was measured.

TABLE 1

Figure 10:
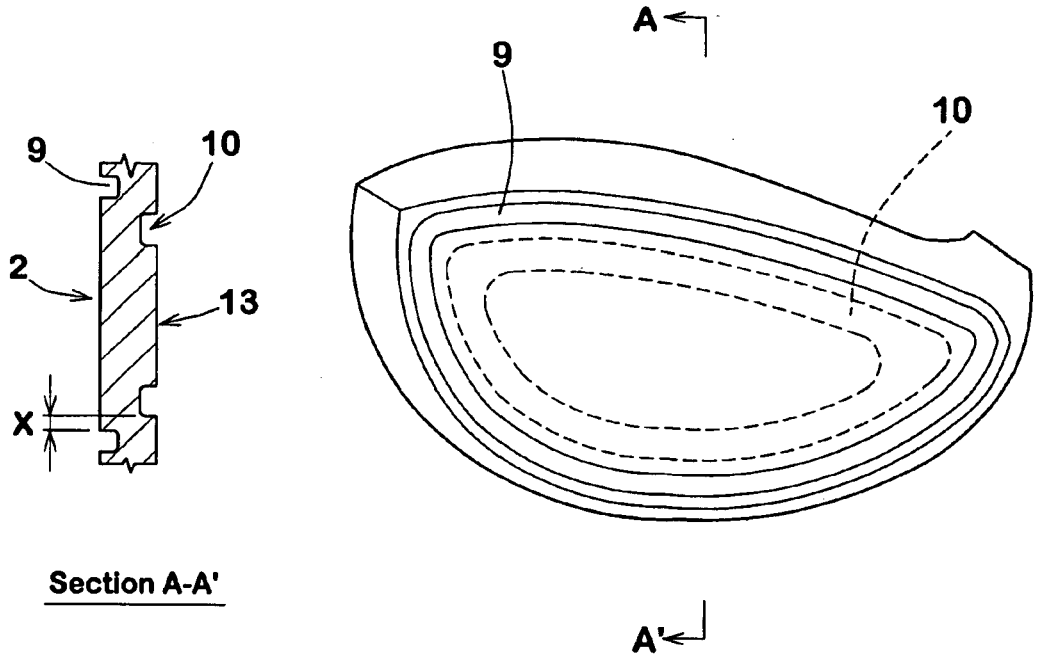
Figure 11:
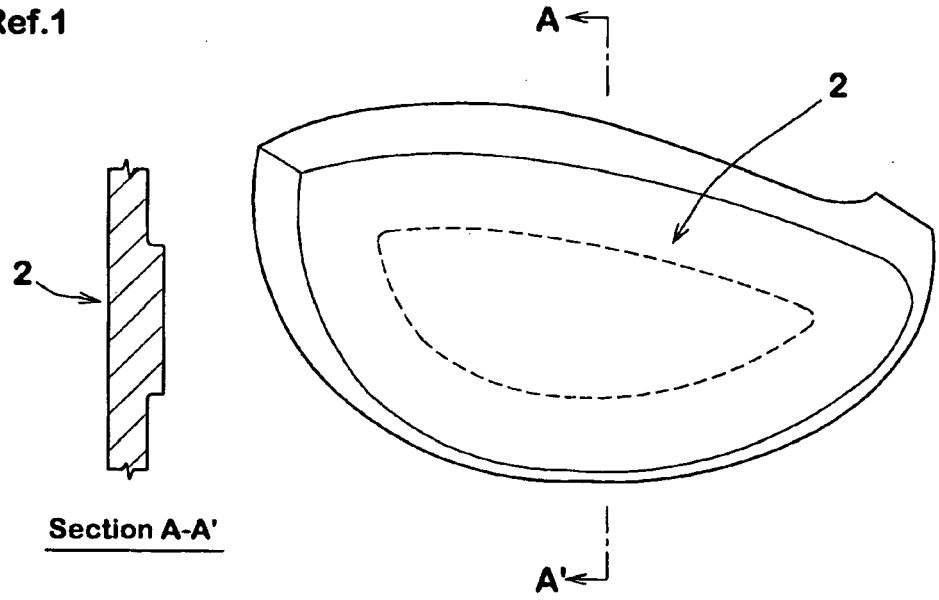
Figure 12:
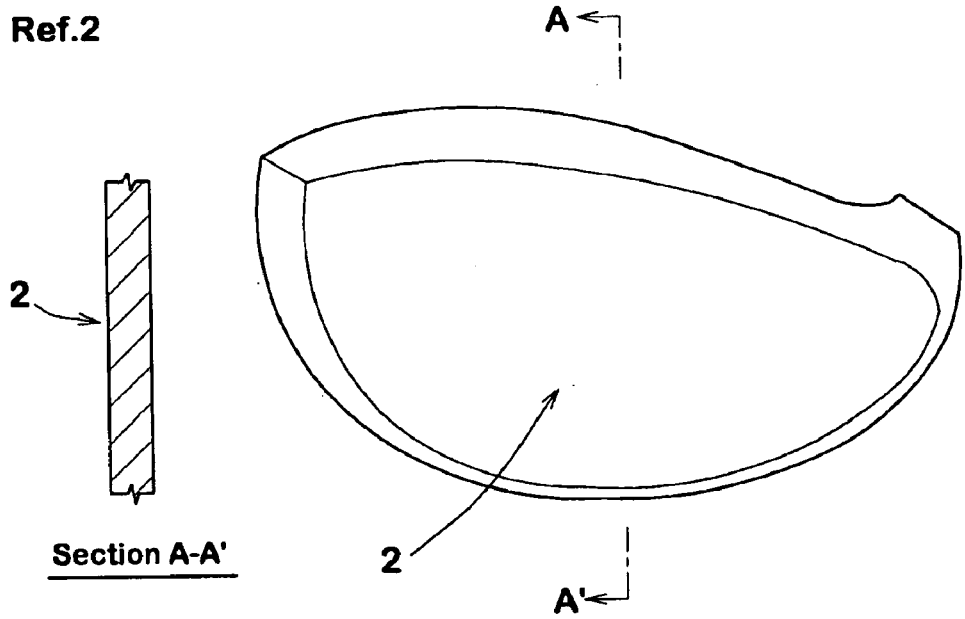
Figure 13:
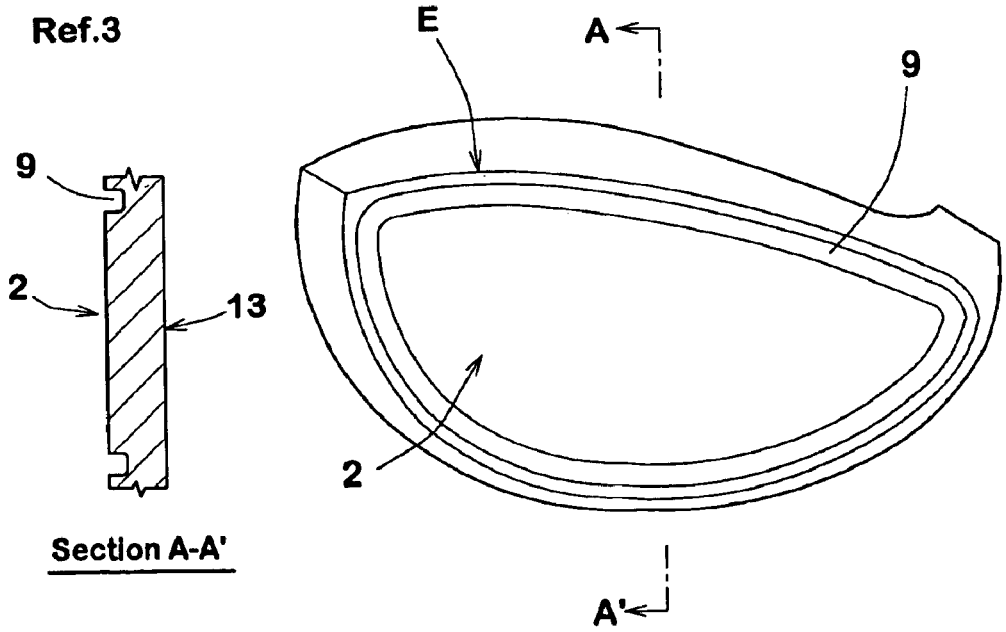

| Head | Ex. 1 | Ex. 2 | Ex. 3 | EX. 4 | Ex. 5 | Ex. 6 | Ref. 1 | Ref. 2 | Ref. 3 |
|---|---|---|---|---|---|---|---|---|---|
| Face portion | FIG. 3 | FIG. 3 | FIG. 3 | FIG. 3 | FIG. 7(a) | FIG. 10 | FIG. 11 | FIG. 12 | FIG. 13 |
| Impact area thickness T (mm) | 3.0 | 3.0 | 3.0 | 3.0 | 3.0 | 3.0 | 3.0 | 3.0 | 3.0 |
| Frontal groove | | | | | | | | | |
| Groove width W1 (mm) | 1.0 | 3.0 | 3.0 | 3.0 | 3.0 | 3.0 | 3.0 | 3.0 | 3.0 |
| Thickness tu1 (mm) | 2.5 | 2.5 | 2.5 | 2.5 | 2.5 | 2.5 | — | — | 2.5 |
| Backside groove | | | | | | | | | |
| Groove width W2 (mm) | 8.0 | 8.0 | 8.0 | 8.0 | 8.0 | 6.0 | 12.0 | — | — |
| Thickness tu2 (mm) | 2.5 | 2.5 | 2.5 | 2.5 | 2.5 | 2.5 | 2.5 | — | — |
| Distance X (mm) | 2.5 | 4.5 | 7.0 | 9.5 | 2.5 | 2.5 | — | — | — |
| Coefficient of restitution | 0.835 | 0.837 | 0.839 | 0.841 | 0.835 | 0.837 | 0.825 | 0.81 | 0.817 |
| Durability (dent in mm) | 0.10 | 0.10 | 0.11 | 0.12 | 0.08 | 0.09 | 0.10 | 0.07 | 0.10 |

From the test results, it was confirmed that the coefficient of restitution can be improved without deteriorating the durability.

As described above, in the golf club head according to the present invention, both the front and back faces of the face portion are provided with grooves in a specific arrangement. Therefore, the flexure of the face portion when hitting a ball is increased to improve the coefficient of restitution, and as a result the carry can be increased. Further, due to the presence of the frontal groove and backside groove, the stress at the time of impact is dispersed in a wide range and deterioration in the durability can be prevented.

The present invention is suitably applied to a wood-type golf club head, but it can be also applied to various club heads such as iron-type, utility-type and patter-type.

What is claimed is:

1. A golf club head comprising a face portion having a front face defining a clubface for hitting a ball and a back face facing a hollow, said clubface provided along the edge thereof with a frontal groove having a groove width of not less than 0.5 mm, and said back face provided with a backside groove extending along the frontal groove, wherein the backside groove has a groove width in a range of from 6 to 30 times the groove width of the frontal groove.

2. A golf club head according to claim 1, wherein the width of the frontal groove is not more than 4.0 mm.

3. A golf club head according to claim 1, wherein the groove width of the backside groove is in a range of from 1.0 to 15.0 mm.

4. A golf club head comprising a face portion having a front face defining a clubface for hitting a ball and a back face facing a hollow, said clubface provided along the edge thereof with a frontal groove having a groove width of not less than 0.5 mm, and said back face provided with a backside groove extending along the frontal groove, wherein the frontal groove is continuous, and the backside groove is surrounded and enclosed by the frontal groove when viewed from the front.

5. A golf club head according to claim 4, wherein the distance between the frontal groove and backside groove is in a range of from 2.5 to 10 mm when viewed from the front.

6. A golf club head comprising a face portion having a front face defining a clubface for hitting a ball and a back face facing a hollow, said clubface provided along the edge thereof with a frontal groove having a groove width of not less than 0.5 mm, and said back face provided with a backside groove extending along the frontal groove, wherein the frontal groove is discontinuous, and the backside groove is surrounded by the frontal groove when viewed from the front.

7. A golf club head according to claim 6, wherein the distance between the frontal groove and backside groove is in a range of from 2.5 to 10 mm when viewed from the front.

8. A golf club head according to claim 4 or 6, wherein the backside groove has a groove width more than the groove width of the frontal groove.

9. A golf club head comprising a face portion having a front face defining a clubface for hitting a ball and a back face facing a hollow, said clubface provided along the edge thereof with a frontal groove having a groove width of not less than 0.5 mm and not more than 4.0 mm, and said back face provided with a backside groove extending along the frontal groove, wherein said groove width of the frontal groove is between 1.0 mm and 3.0 mm.

10. A golf club head according to claim 9, wherein the frontal groove is continuous.

11. A golf club head according to claim 9, wherein the frontal groove is discontinuous.

12. A golf club head according to claim 9, 10, or 11, wherein the backside groove is continuous, and the distance between the frontal groove and backside groove is in a range of from 2.5 to 10 mm when viewed from the front.

13. A golf club head comprising a face portion having a front face defining a clubface for hitting a ball and a back face facing a hollow, said clubface provided along the edge thereof with a frontal groove having a groove width of not less than 0.5 mm but not more than 4.0 mm, and said back face provided with a backside groove extending along the frontal groove, wherein said frontal groove is disposed outside an impact area (P) of the clubface, and the total length of the frontal groove along the edge is at least 40% of the overall length of the edge.

14. A golf club head according to claim 13, wherein said groove width of the frontal groove is between 1.0 mm and 3.0 mm.

* * * * *